US011919688B2

(12) United States Patent
Lee et al.

(10) Patent No.: US 11,919,688 B2
(45) Date of Patent: Mar. 5, 2024

(54) CONTENT CONTAINER

(71) Applicant: KOLMAR BNH CO., LTD, Daejeon (KR)

(72) Inventors: Chang Soo Lee, Sejong (KR); Koo Sup Ahn, Sejong (KR); Jong Hyun Park, Sejong (KR); Sang In Han, Sejong (KR); Hye Jin Jung, Sejong (KR)

(73) Assignee: KOLMAR BNH CO., LTD, Daejeon (KR)

( * ) Notice: Subject to any disclaimer, the term of this patent is extended or adjusted under 35 U.S.C. 154(b) by 429 days.

(21) Appl. No.: 17/292,478

(22) PCT Filed: Mar. 18, 2021

(86) PCT No.: PCT/KR2021/003349

§ 371 (c)(1),
(2) Date: May 10, 2021

(87) PCT Pub. No.: WO2021/194160

PCT Pub. Date: Sep. 30, 2021

(65) Prior Publication Data

US 2022/0161975 A1 May 26, 2022

(30) Foreign Application Priority Data

Mar. 26, 2020 (KR) ..... 10-2020-0037081

(51) Int. Cl.
*B65D 51/28* (2006.01)

(52) U.S. Cl.
CPC ..... *B65D 51/285* (2013.01)

(58) Field of Classification Search
CPC ..... A45D 34/06; B65D 41/62; B65D 51/18; B65D 51/28; B65D 51/2807;
(Continued)

(56) References Cited

U.S. PATENT DOCUMENTS 6,513,650 B2 * 2/2003 Mollstam ..... B65D 81/3222 206/219
8,356,711 B2 * 1/2013 Canziani Hoffa . B65D 51/2828 206/222
(Continued)

FOREIGN PATENT DOCUMENTS

JP 2007-076738 A 3/2007
JP 2007-269403 A 10/2007
(Continued)

*Primary Examiner* — Bryon P Gehman
(74) *Attorney, Agent, or Firm* — Bridgeway IP Law Group, PLLC; Sang Ho Lee; Hyun Woo Shin

(57) ABSTRACT

According to an embodiment of the present disclosure, a content container is provided. The content container may include: a container part configured to accommodate a liquid content; an upper cap that is detachably coupled to the container part and includes a first accommodation part configured to accommodate a solid content and a pressing part moved by being pressed; and a lower cap that is inserted into the container part, and includes an accommodation tube forming a second accommodation part and a plurality of communication holes formed in the outside of the accommodation tube to communicate with the container part, wherein, by pressing the upper cap, the solid content is moved from the first accommodation part to the second accommodation part.

15 Claims, 10 Drawing Sheets

(58) Field of Classification Search
CPC .. B65D 51/2828; B65D 51/285; B65D 53/02; B65D 81/32; B65D 83/04
USPC ..... 206/219
See application file for complete search history.

(56) References Cited

U.S. PATENT DOCUMENTS

| | | | | |
|---|---|---|---|---|
| 2002/0179461 | A1* | 12/2002 | Mollstam | B65D 81/3222 206/219 |
| 2006/0118435 | A1* | 6/2006 | Cronin | B65D 47/243 206/219 |
| 2007/0215496 | A1 | 9/2007 | Scarborough | |
| 2016/0264323 | A1 | 9/2016 | Jeon | |
| 2017/0253399 | A1* | 9/2017 | Shen | A61J 1/2093 |

FOREIGN PATENT DOCUMENTS

| | | | |
|---|---|---|---|
| KR | 10-2003-0096162 | A | 12/2003 |
| KR | 20-0369670 | Y1 | 12/2004 |
| KR | 10-1503798 | B1 | 3/2015 |
| KR | 10-1525862 | B1 | 6/2015 |
| KR | 10-2015-0105565 | A | 9/2015 |
| KR | 20-2018-0002032 | U | 7/2018 |
| KR | 10-2149667 | B1 | 8/2020 |
| TW | 200902393 | A | 1/2009 |
| TW | M547540 | U | 8/2017 |
| WO | 2019/135065 | A | 7/2019 |

* cited by examiner

CONTENT CONTAINER

BACKGROUND

1. Field of the Invention

The present disclosure relates to a content container, and specifically, relates to a content container which allows a solid content and a liquid content to be used simultaneously or individually.

2. Discussion of Related Art

Since health supplements such as vitamins and lactic acid bacteria are provided in the dosage form of powders or pills, the health supplements are usually consumed with beverages. However, in this case, there is inconvenience in that a user should separately carry the health supplements and beverage containers, and should open containers of the health supplements and the beverage containers when ingesting the health supplements.

To solve this problem, beverage containers have been proposed in which the health supplements are stored together in lids of the beverage containers. In such beverage containers, although the health supplements are stored separately from beverages in the containers, tight sealing is not provided, and thus contents are frequently mixed with each other or spoiled. In particular, in the case of solid contents that are vulnerable to an external environment such as vitamins and lactic acid bacteria, there is a problem in that the solid contents are easily spoiled by humidity even when not in direct contact with beverages.

SUMMARY OF THE INVENTION

The present disclosure is directed to providing a content container that allows a solid content and a liquid content to be used simultaneously or individually.

The technical aspects of the present disclosure are not limited to the aspects described above, and those skilled in the art will clearly understand other technical aspects not described from the following descriptions.

According to embodiments of the present disclosure, a content container is provided. A content container includes: a container part configured to accommodate a liquid content; an upper cap that is detachably coupled to the container part and includes a first accommodation part configured to accommodate a solid content, and a pressing part moved by being pressed; and a lower cap that is inserted into the container part, and includes an accommodation tube forming a second accommodation part and a plurality of communication holes formed in the outside of the accommodation tube to communicate with the container part, wherein, by pressing the upper cap, the solid content is moved from the first accommodation part to the second accommodation part.

At least a portion of the pressing part may be exposed to the outside and the pressing may be applied to the pressing part, and the first accommodation part may be opened by the movement of the pressing part, and thus the solid content may move to the second accommodation part.

The pressing part may include a pressing wall which is formed in a horizontal direction and to which the pressing is applied; and a support tube that is formed downward from the pressing wall and has an inclined end, and when the pressing part moves, the inclined end may cut a bottom surface of the first accommodation part to open the first accommodation part.

The inclined end may cut only a portion of the bottom surface, and thus the bottom surface may be prevented from being separated from the upper cap and being moved to the second accommodation part.

At least a portion of the pressing part may be made of a transparent or semitransparent material, and an inside of the first accommodation part may be visible through the pressing part.

The solid content moved to the second accommodation part and the liquid content in the container part may be blocked by the accommodation tube.

When the upper cap is separated from the container part in a state in which the solid content is located in the first accommodation part, the solid content may be discharged to the outside from the first accommodation part by pressing the upper cap.

When the upper cap is separated from the container part after the solid content moves to the second accommodation part, the second accommodation part and the communication holes may be opened, and thus the solid content and the liquid content may be exposed to the outside.

The second accommodation part may be located below the first accommodation part, and function as an air pocket for the first accommodation part.

An upper end of the accommodation tube may be in close contact with a bottom surface of the upper cap to seal the second accommodation part.

The lower cap may further include: an outer frame having a locking part coupled to an upper end of the container part; and a bridge connecting the outer frame and the accommodation tube to form the communication holes.

The upper cap may further include: an inner cap detachably coupled to the outside of an upper end of the container part; and an outer cap coupled to the outside of the inner cap and accommodating the pressing part.

The outer cap may include: an upper wall that has a through region formed therein; an outer wall that extends downward along a circumference of the upper wall and is in close contact with the inner cap; and a protection tube that extends downward along a circumference of the through region, has the pressing part disposed therein, and guides the movement of the pressing part.

The outer cap may have an upper protrusion and a lower protrusion respectively in contact with an upper surface and a lower surface of the pressing part to maintain a position of the pressing part.

The inner cap may include: an inner wall that is coupled to the container part; a sealing part that extends inward from the inner wall and is in contact with the accommodation tube to seal the second accommodation part; and a guide tube that extends upward from the sealing part, forms a portion of the first accommodation part, guides the movement of the pressing part, and limits a movement range of the pressing part.

Advantageous Effects

According to the present disclosure, a solid content and a liquid content are separate and stored in a content container, and thus the solid content can be prevented from being melted or spoiled by the liquid content.

According to the present disclosure, the solid content is accommodated in a first accommodation part, a second accommodation part in a sealed state is provided at a lower end of the first accommodation part, and thus the second accommodation part can protect the solid content from humidity or heat while functioning as an air pocket for the first accommodation part. In particular, the solid content that is vulnerable to an external environment, such as vitamins and lactic acid bacteria, can be more safely stored.

Further, according to the present disclosure, a portion of the upper cap is formed of a transparent or semitransparent material, the solid content is accommodated therein, and thus a user can visually observe the solid content.

Further, according to the present disclosure, by pressing the upper cap, the solid content in the first accommodation part can move to the second accommodation part. When the upper cap is separated, the second accommodation part is opened, and thus the solid content and the liquid content can be simultaneously provided to the user.

Further, according to the present disclosure, the upper cap in which the solid content is accommodated is separated, the pressing part is moved, and thus the solid content is discharged. Therefore, the solid content and the liquid content can be separated and provided to the user.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
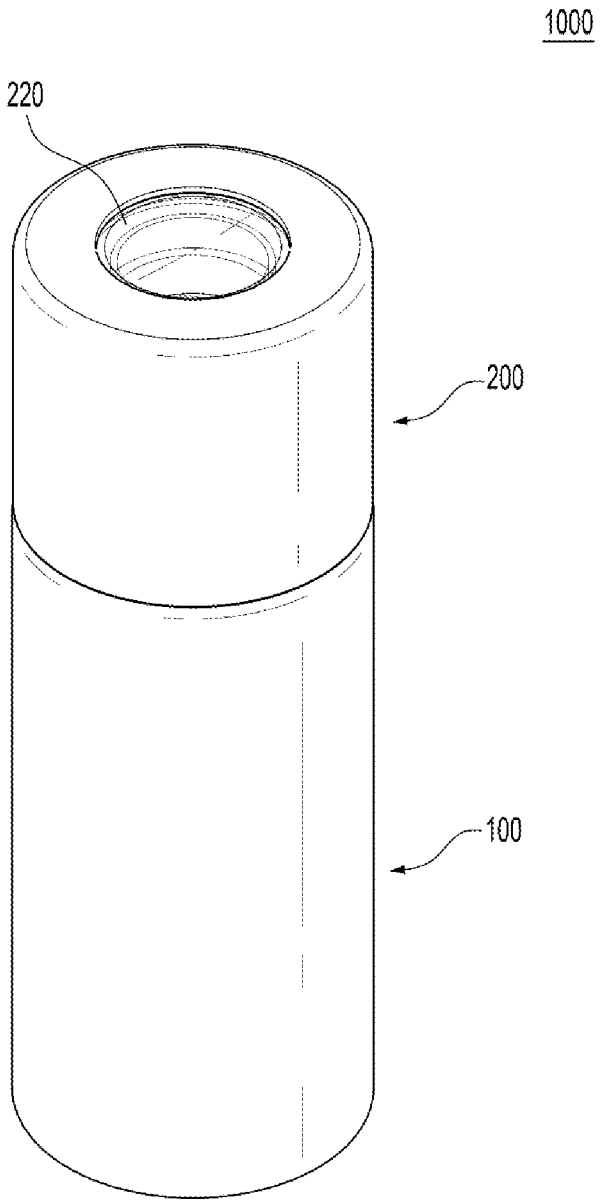
FIG. 1 is a perspective view of a content container according to an embodiment of the present disclosure.

Hereinafter, exemplary embodiments of the present disclosure will be described in detail with reference to contents described in the accompanying drawings. The same reference numerals or symbols presented in each drawing indicate parts or components that perform substantially the same function. Hereinafter, for convenience of description, the up, down, left, and right directions are based on the drawings, and the scope of the present disclosure is not necessarily limited to the corresponding directions.

Terms including an ordinal number such as first and second may be used to describe various components, but the components are not limited by the terms. The terms are used only for the purpose of distinguishing one component from another component. For example, without departing from the scope of the present disclosure, a first component may be referred to as a second component, and similarly, the second component may be referred to as the first component. The term "and/or" includes a combination of a plurality of listed items or any one of the plurality of listed items.

Terms used in the present specification are used only to describe embodiments and are not intended to limit/restrict the present disclosure. Singular expressions include plural expressions unless clearly otherwise indicated in the context. It should be understood that terms such as include or have used herein are intended to indicate that there are features, numbers, steps, operations, components, parts, or combinations thereof that are described in the specification and do not exclude in advance the possibility of the presence or addition of one or more other features, numbers, steps, operations, components, parts, or combinations thereof.

Throughout the specification, when a first part is connected to a second part, this includes not only a case in which the first part is directly connected to the second part but also a case in which the first part is indirectly connected to the second part with a third part interposed therebetween. Further, when a part includes a component, this means that another component is not excluded but may be further included unless otherwise stated.

Figure 2:
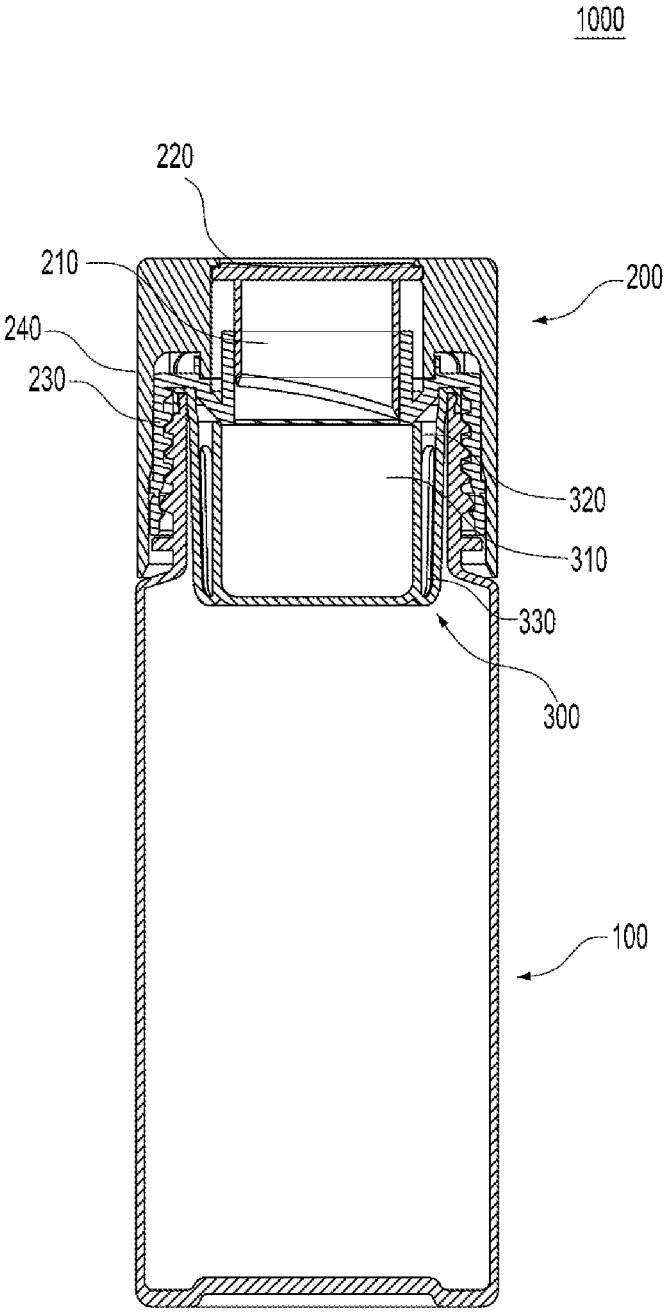
FIG. 2 is a cross-sectional view of the content container according to the embodiment of the present disclosure.
Figure 3:
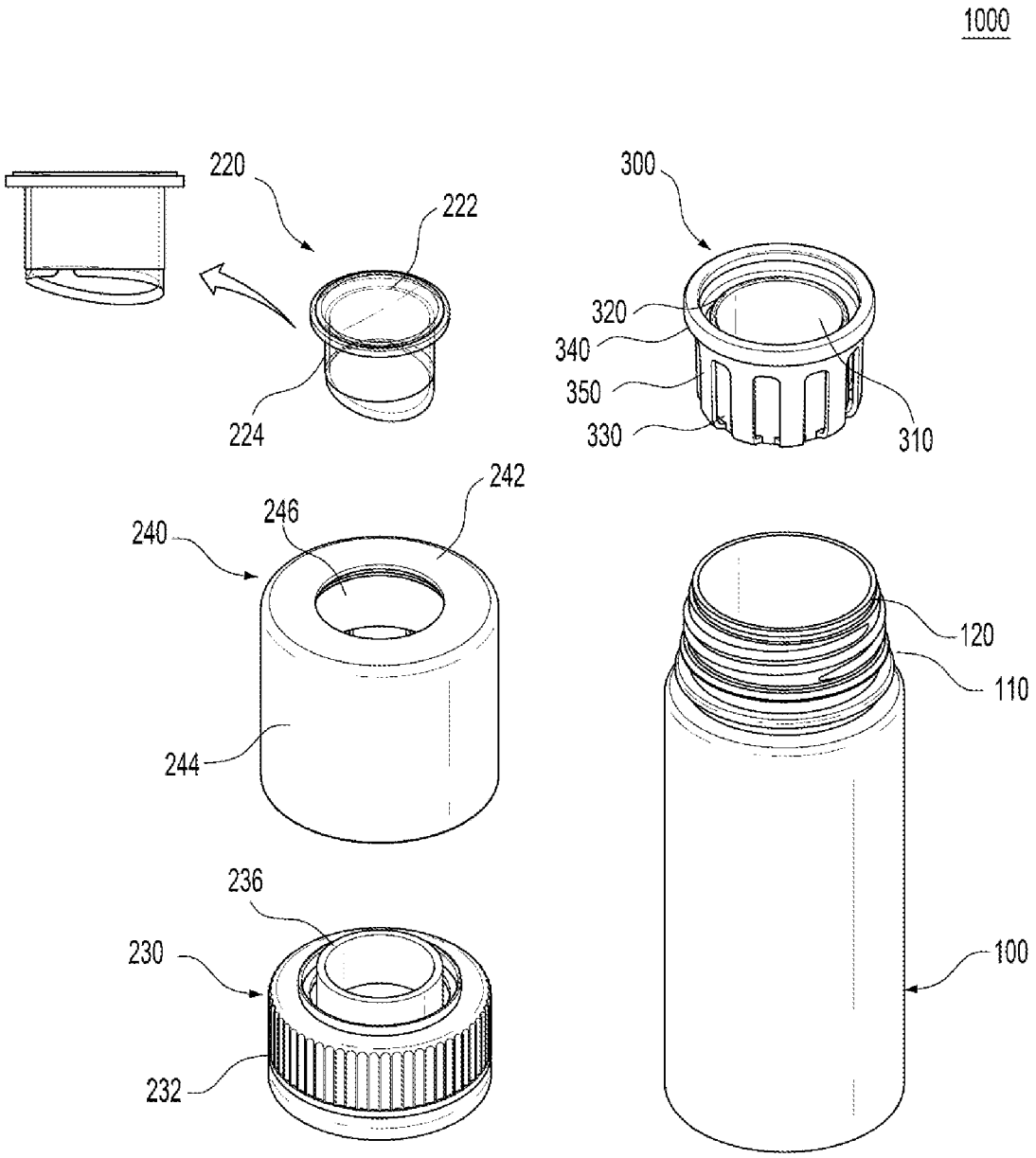
FIG. 3 is an exploded perspective view of the content container according to the embodiment of the present disclosure.
Figure 4:
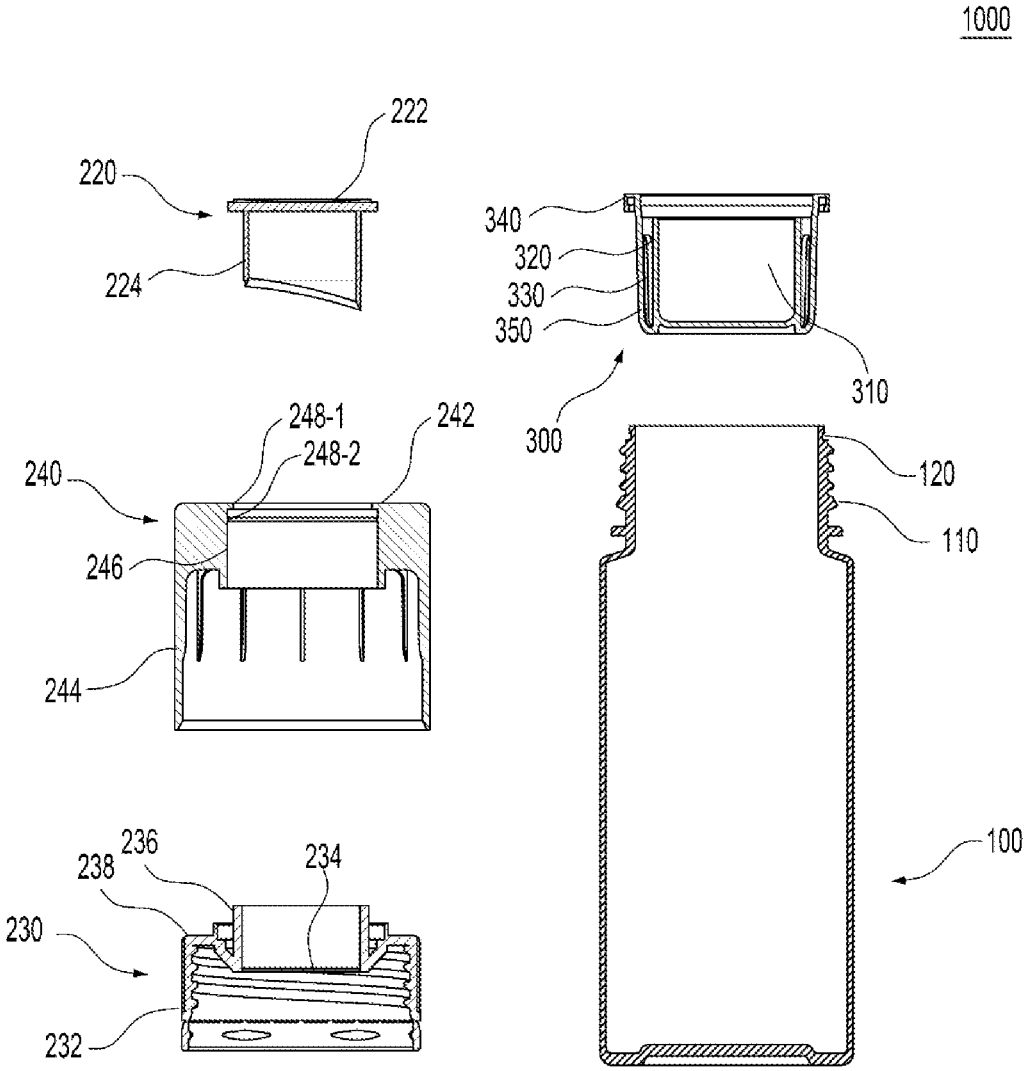
FIG. 4 is an exploded sectional view of the content container according to the embodiment of the present disclosure.

FIG. 1 is a perspective view of a content container according to an embodiment of the present disclosure, FIG. 2 is a cross-sectional view of the content container according to the embodiment of the present disclosure, FIG. 3 is an exploded perspective view of the content container according to the embodiment of the present disclosure, and FIG. 4 is an exploded sectional view of the content container according to the embodiment of the present disclosure.

Referring to FIGS. 1 to 4, a content container 1000 may include a container part 100, an upper cap 200, and a lower cap 300.

The container part 100 may have an open upper side and thus have an accommodation space therein. A liquid content may be accommodated in the accommodation space. The liquid content may be, for example, an edible content such as a soft drink, water, coffee, yogurt, or milk. However, the present disclosure is not limited thereto, and various types of liquid contents that may be used alone or together with the solid content may be accommodated in the container part 100.

In the embodiment, a thread may be formed outside a upper end 110 of the container part 100. The container part 100 may be screw-coupled to the upper cap 200 through the thread.

In the embodiment, a locking groove 120 may be formed in the outside of the upper end 110 of the container part 100. By fitting and coupling a locking part to the locking groove 120, an outer frame 340 of the lower cap 300 may be coupled to the container part 100.

The upper cap 200 may be detachably coupled to the upper end 110 of the container part 100 and, thus open or close the accommodation space. Further, the upper cap 200 may be formed with a first accommodation part 210 therein and thus accommodate solid content. Here, the first accommodation part 210 may be, for example, an accommodation space formed by an inner cap 230 and a pressing part 220, but the present disclosure is not limited thereto. The solid content is, for example, an edible content such as lactic acid bacteria or vitamins, and may have dosage forms such as tablets, granules, and powders. However, the present disclosure is not limited thereto, and various types of solid contents that may be used alone or together with the liquid content may be accommodated in the first accommodation part 210.

When an external force is applied from a user, the solid content in the first accommodation part 210 of the upper cap 200 may move to a second accommodation part 310 of the lower cap 300. To this end, the upper cap 200 may have the pressing part 220 that is movable downward by receiving the external force from the user. At least a portion of the pressing part 220 may be exposed to the outside so that the external force may be applied thereto, and the pressing part 220 may open the first accommodation part 210 while being moved by pressing. Accordingly, the solid content in the first accommodation part 210 may move to and may be accommodated in the second accommodation part 310.

In the embodiment, the pressing part 220 may include a pressing wall 222 that is formed in a horizontal direction, is exposed to the outside, and receives the external force, and a support tube 224 formed downward from the pressing wall 222. When the pressing part 220 is moved by pressing, a movement range of the pressing wall 222 may be limited by a guide tube 236 of the inner cap 230. That is, the pressing part 220 may move until the pressing wall 222 comes into contact with the guide tube 236. By the moving, an end of the support tube 224 may cut at least a portion of the circumference of the bottom surface of the first accommodation part 210 to open the first accommodation part 210. In this case, the downward movement of the support tube 224 may be guided by the guide tube 236.

In the embodiment, the end of the support tube 224 may be formed so that one region of the circumference thereof protrudes further downward than other regions. In this case, among the end of the support tube 224, the protruding region (that is, a cutting region) may cut the bottom surface to open the first accommodation part 210, and the non-protruding region (that is, a pressing region) may press the bottom surface downward so that the bottom surface does not interfere with the opening of the first accommodation part 210. For example, the end of the support tube 224 may be an inclined end. A portion of the bottom surface of the first accommodation part 210 may be cut by the inclined end (that is, the cutting region of the inclined end, or the like). Since only a part is cut, the bottom surface may be prevented from being separated from the upper cap 200 and being moved to the second accommodation part 310.

Additionally/alternatively, the end of the support tube 224 may have a downward pointed tip along the circumference. In this case, the pointed tip formed at the end of the support tube 224 may more easily cut the bottom surface to open the first accommodation part 210. In this case, the pointed tip may be formed in the entire circumference of the end of the support tube 224 or formed in a portion of the circumference thereof (for example, the cutting region, or the like). In the latter case, the end in which the pointed tip is formed may cut the bottom surface to open the first accommodation part 210, and the end (for example, the pressing region or the like) in which the pointed tip is not formed may press the bottom surface so that the bottom surface is rotated or bent downward. That is, since complete cutting of the bottom surface is prevented, the bottom surface may be prevented from interfering with the solid content moving from the first accommodation part 210 to the second accommodation part 310.

Additionally/alternatively, the pressing region of the support tube 224 may be located on the upper side to be spaced apart from the adjacent cutting region by a predetermined distance or more. The cutting by the cutting region is completed while the pressing region descends the separation distance, and thus the pressing region may be prevented from coming into contact with the bottom surface and obstructing the cutting before the cutting by the cutting region is completed.

In the embodiment, the upper surface of the pressing wall 222 may be formed to be recessed downward. The external force may be more easily applied from the user through the recessed upper surface.

In the embodiment, at least a portion of the pressing part 220 is made of a transparent or semitransparent material so that the inside of the pressing part 220 is visible. That is, the solid content located in the first accommodation part 210 can be visually observed through the pressing part 220 exposed to the outside. Further, even after the solid content moves from the first accommodation part 210 to the second accommodation part 310, the solid content may be visually observed through the pressing part 220 without separating the upper cap 200.

In the embodiment, the upper cap 200 may include: the inner cap 230 detachably coupled to the outside of the upper end 110 of the container part 100; and an outer cap 240 which is coupled to the outside of the inner cap 230 and will accommodate the pressing part 220 therein.

In the embodiment, the inner cap 230 may include an inner wall 232, a sealing part 234, the guide tube 236, and a pushing part 238. The inner wall 232 may be formed to surround the upper end 110 of the container part 100, may have an inwardly formed thread, and thus may be screw-coupled to the container part 100. The sealing part 234 may be formed inward from the upper end of the inner wall 232. The upper surface of the sealing part 234 may form the bottom surface of the first accommodation part 210, and the lower surface of the sealing part 234 may be in contact with an accommodation tube 320 of the lower cap 300 to seal the second accommodation part 310. The guide tube 236 may be formed to extend upward of the sealing part 234. The guide tube 236 may form a portion of the first accommodation part 210, and guide the movement of the pressing part 220 while being in contact with the support tube 224 of the inward pressing part 220. In particular, the guide tube 236 may allow the pressing part 220 to move until the upper end thereof comes into contact with the bottom surface of the pressing wall 222, thereby limiting the movement range of the pressing part 220. The pushing part 238 may be formed between the sealing part 234 and the inner wall 232 and may be in contact with the upper surface of the locking part. When the inner cap 230 is coupled to the container part 100, the pushing part 238 may press the locking part, the lower cap 300 may be more firmly coupled to the container part 100, and the liquid content can be prevented from leaking through the locking part.

In the embodiment, a cutting groove corresponding to the end of the pressing part 220 may be formed in the sealing part 234, that is, the bottom surface of the first accommodation part 210. The end of the pressing part 220 may cut the bottom surface more smoothly through the cutting groove. In this case, the cutting groove may be formed to correspond to the entire circumference of the end of the pressing part 220 or formed to correspond to a portion of the circumference of the end of the pressing part 220. In the latter case, even when the end of the pressing part 220 moves, cutting of a region of the bottom surface in which the cutting groove is not formed may be prevented. That is, while preventing complete cutting of the bottom surface, the bottom surface may be prevented from interfering with the solid content moving from the first accommodation part 210 to the second accommodation part 310.

In the embodiment, the outer cap 240 may include an upper wall 242, an outer wall 244, and a protection tube 246. The upper wall 242 may have a through region formed therein so that a portion of the pressing part 220 may be exposed to the outside. The outer wall 244 may be formed to extend downward from the circumference of the upper wall 242. The outer wall 244 of the outer cap 240 may be in close contact with the inner wall 232 of the inner cap 230 to integrate the outer cap 240 and the inner cap 230. The protection tube 246 may extend downward from the circumference of the through region and allow the pressing part 220 to be disposed therein. When the outer cap 240 is coupled to the inner cap 230, a lower end of the protection tube 246 may be supported by the upper surface of the inner cap 230 (particularly, the pushing part 238), and the inner surface of the protection tube 246 may be in contact with the pressing part 220 (for example, a side surface of the pressing wall 222) so that the movement of the pressing part 220 may be guided.

In the embodiment, the outer wall 244 may be rotated by receiving the external force from the user, and while the inner wall 232 rotates according to the rotation of the outer wall 244, the upper cap 200 and the container part 100 may be screw-coupled to or released from each other. To this end, the inner cap 230 and the outer cap 240 may be coupled to rotate in synchronization with each other. For example, at least one coupling protrusion may be formed on the inner surface of the outer wall 244 of the outer cap 240 in the vertical direction, and at least one coupling groove corresponding thereto may be formed on the outer surface of the inner wall 232 of the inner cap 230.

In the embodiment, the outer cap 240 may be provided with an upper locking protrusion 248-1 and a lower locking protrusion 248-2 in contact with the upper surface and the lower surface of the pressing part 220 to maintain the position of the pressing part 220. The upper locking protrusion 248-1 may prevent the pressing part 220 from being separated to the upper side, that is, the outside, and the lower locking protrusion 248-2 may prevent the pressing part 220 from moving downward. When the external force is applied to the pressing part 220, the pressing part 220 may move downward beyond the lower locking protrusion 248-2. The upper locking protrusion 248-1 and the lower locking protrusion 248-2 are illustrated as being formed on the upper inner surface of the protection tube 246 to fix the position of the pressing part 220 before the downward movement, but this is illustrative, and the upper locking protrusion 248-1 and the lower locking protrusion 248-2 may be formed in another position inside the protection tube 246. Further, additionally/alternatively, an upper locking protrusion and/or a lower locking protrusion for fixing the position of the pressing part 220 after the downward movement may be provided.

The lower cap 300 may be inserted into and disposed in the container part 100. The second accommodation part 310 may be formed in the lower cap 300 by the accommodation tube 320 whose upper side is open. Further, the lower cap 300 may be provided with a plurality of communication holes 330 in the outside of the accommodation tube 320, and through this, the liquid content in the container part 100 may be discharged to the outside.

In the embodiment, the second accommodation part 310 may be located below the first accommodation part 210. In this case, at least a portion of the upper cap 200 may be in contact with the lower cap 300 to seal the second accommodation part 310. For example, while the bottom surface of the sealing part 234 is in close contact with the upper end of the accommodation tube 320, an open upper portion of the second accommodation part 310 may be sealed. The sealed second accommodation part 310 may function as an air pocket for the first accommodation part 210. Thereafter, when the upper cap 200 is separated from the container part 100, the upper portion of the second accommodation part 310 is open, and thus the solid content may be exposed to the user.

In the embodiment, the lower cap 300 may include an outer frame 340 that has a locking part coupled to the upper end 110 (particularly, the locking groove 120) of the container part 100 and a bridge 350 connecting the outer frame 340 and the second accommodation part 310 to form the plurality of communication holes 330 spaced apart from each other. In this case, inflow of the liquid content into the second accommodation part 310 or inflow of the liquid content in the second accommodation part 310 into the container part 100 can be prevented by the sealing of the second accommodation part 310 (particularly, the accommodation tube 320).

Figure 5:
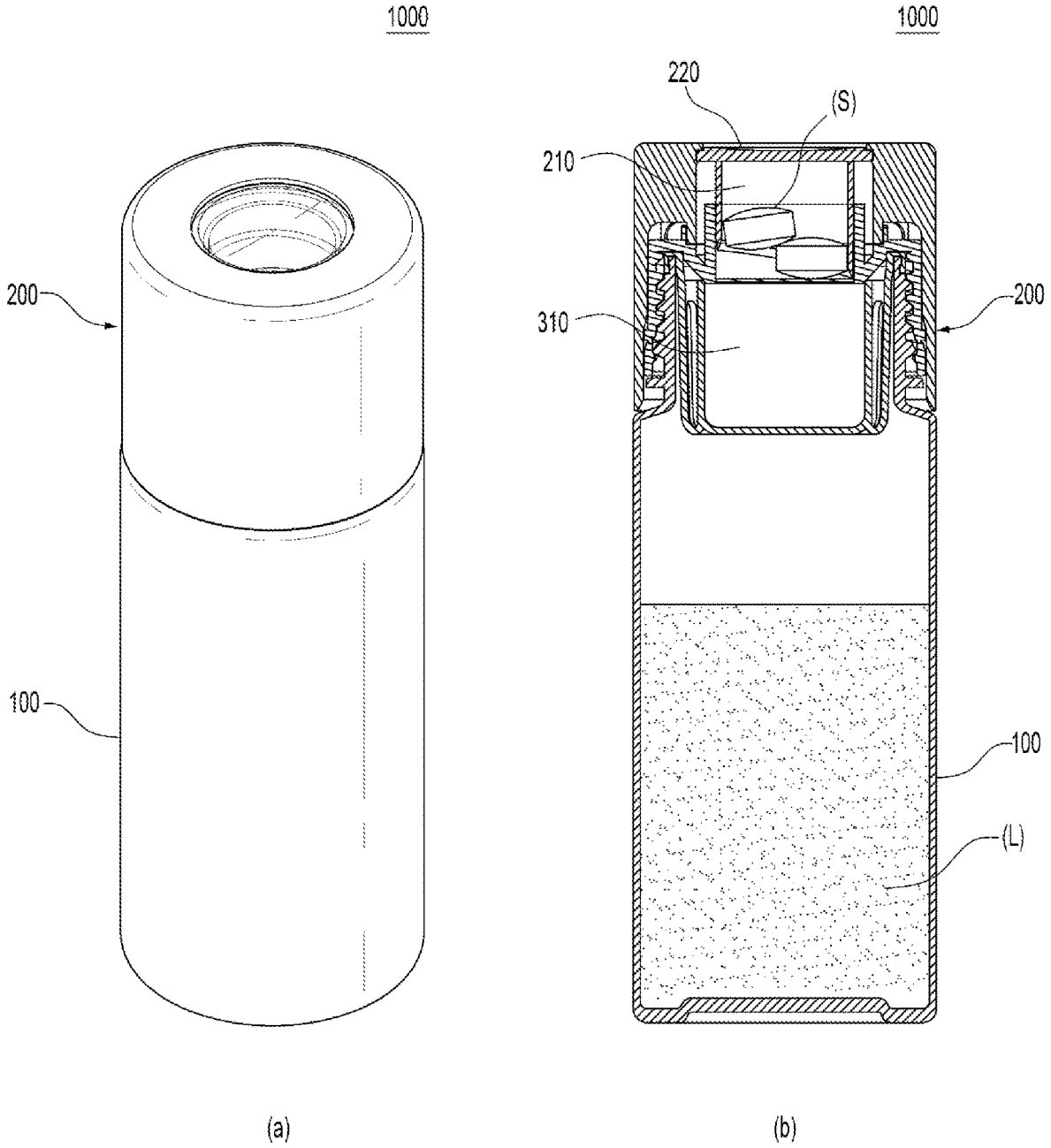
FIGS. 5 to 7 are operational state diagrams of the content container according to the embodiment of the present disclosure.
Figure 6:
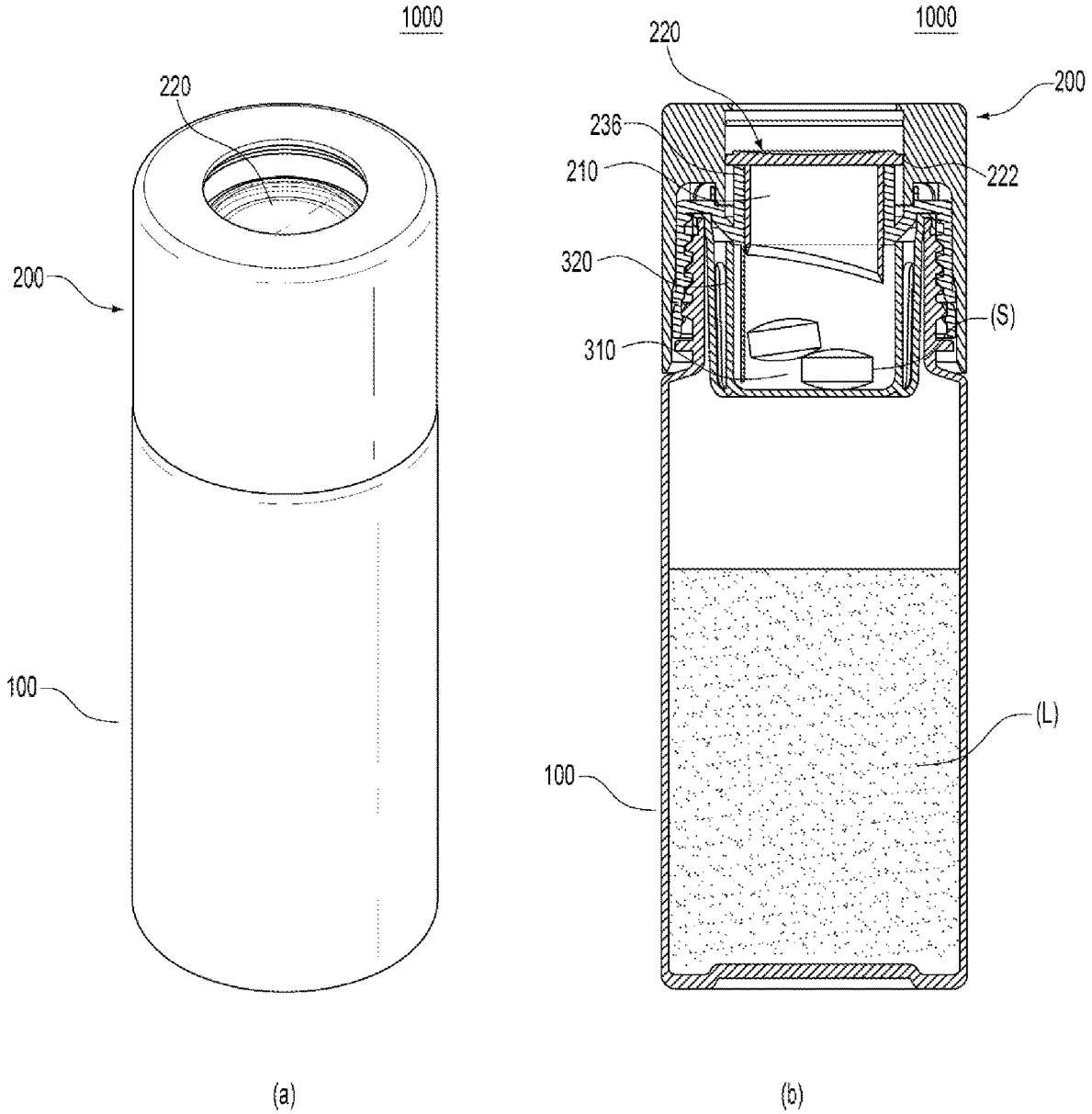
Figure 7:
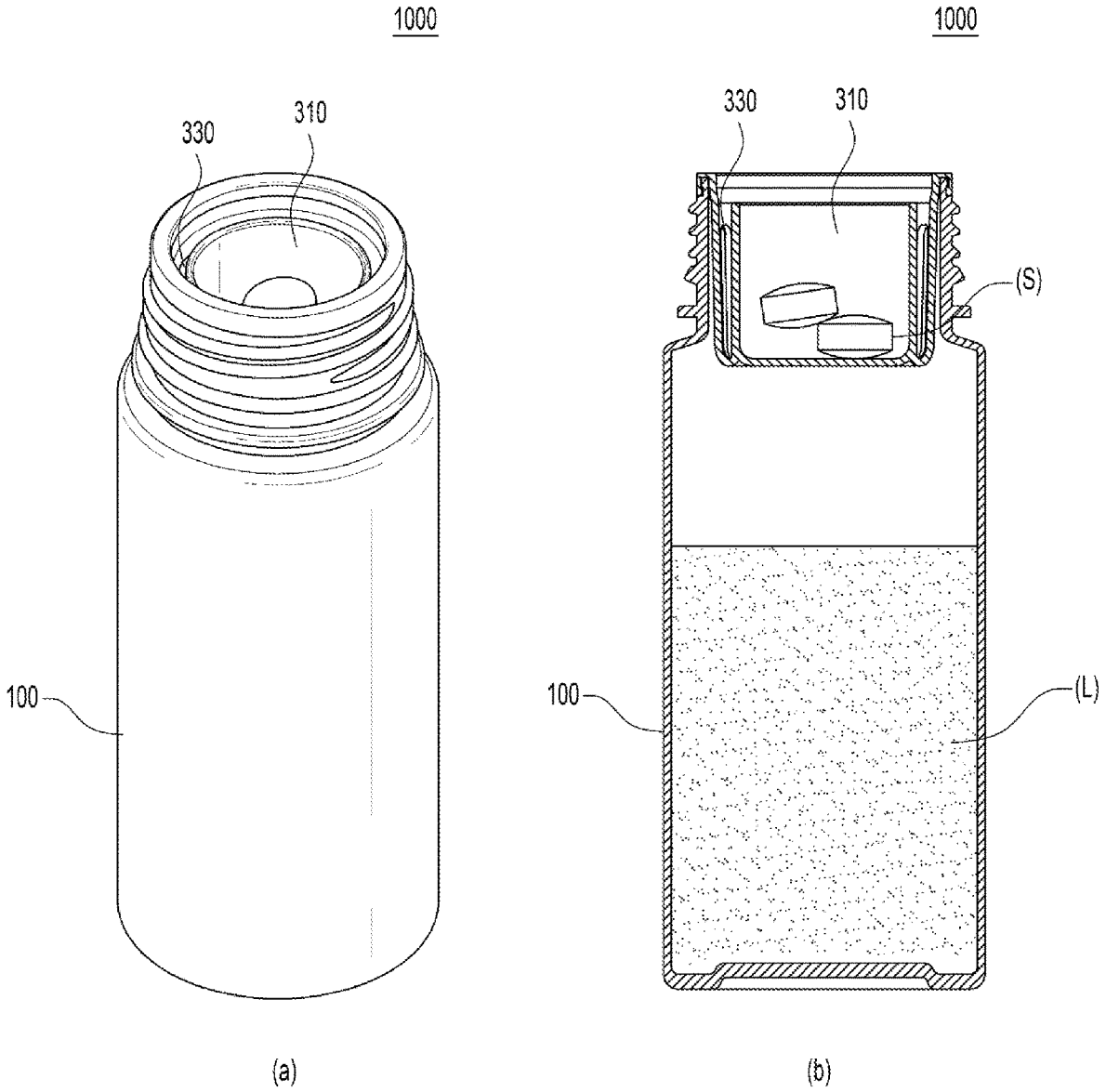

FIGS. 5 to 7 are operational state diagrams of the content container according to the embodiment of the present disclosure.

In detail, FIG. 5 illustrates a state in which a liquid content L and a solid content S are accommodated in the content container 1000, FIG. 6 is illustrates a state in the content container 1000 in which the pressing part 220 of the upper cap 200 is pressed, and FIG. 7 illustrates a state in which the upper cap 200 is separated from the content container 1000.

Referring to FIG. 5, the liquid content L may be accommodated in the container part 100, and the solid content S may be accommodated in the first accommodation part 210 of the upper cap 200. The user may visually observe the solid content S located inside through the pressing part 220 made of a transparent or semitransparent material. Further, since the first accommodation part 210 is blocked from the container part 100, the solid content S may be prevented from being melted or spoiled due to the liquid content L in the container part 100. In particular, as the second accommodation part 310 located below the first accommodation part 210 is maintained in a sealed state, the second accommodation part 310 functions as an air pocket, and thus the solid content S can be protected from humidity or heat. In particular, contents that are vulnerable to an external environment, such as vitamins and lactic acid bacteria, may be more safely stored.

Referring to FIG. 6, by pressing the pressing part 220 of the upper cap 200, the pressing part 220 may be moved downward. In this case, the pressing part 220 has a recessed upper surface, and thus the user may easily press the pressing part 220 with a finger or the like.

The pressing part 220 may move downward without shaking while being in contact with the inner surface of the guide tube 236. The pressing part 220 may move until the bottom surface of the pressing wall 222 comes into contact with the upper end of the guide tube 236, and the inclined end of the pressing part 220 may cut the bottom surface of the first accommodation part 210 by the movement of the pressing part 220.

In this case, only a part of the bottom surface is cut, and thus the bottom surface may be prevented from being completely separated from the upper cap 200 and being moved to the second accommodation part 310. Such partial cutting of the bottom surface may be performed through the limitation of the movement range of the pressing part 220 by the guide tube 236 and the inclined end of the pressing part 220.

Further, the accommodation tube 320 may block a space between the second accommodation part 310 and the container part 100, and thus the solid content S in the second accommodation part 310 is continuously sealed.

Referring to FIG. 7, after the solid content S is moved to the second accommodation part 310, the upper cap 200 may be removed. By removing the upper cap 200, the upper end of the second accommodation part 310 is opened, and thus the solid content S may be exposed to the outside.

Further, since the communication holes 330 in the container part 100 are formed in the outside of the second accommodation part 310, the liquid content L may flow out through the communication holes 330. Thus, the user may perform an action of gripping the container part 100 and drinking to ingest the liquid content L together with the solid content S.

Figure 8:
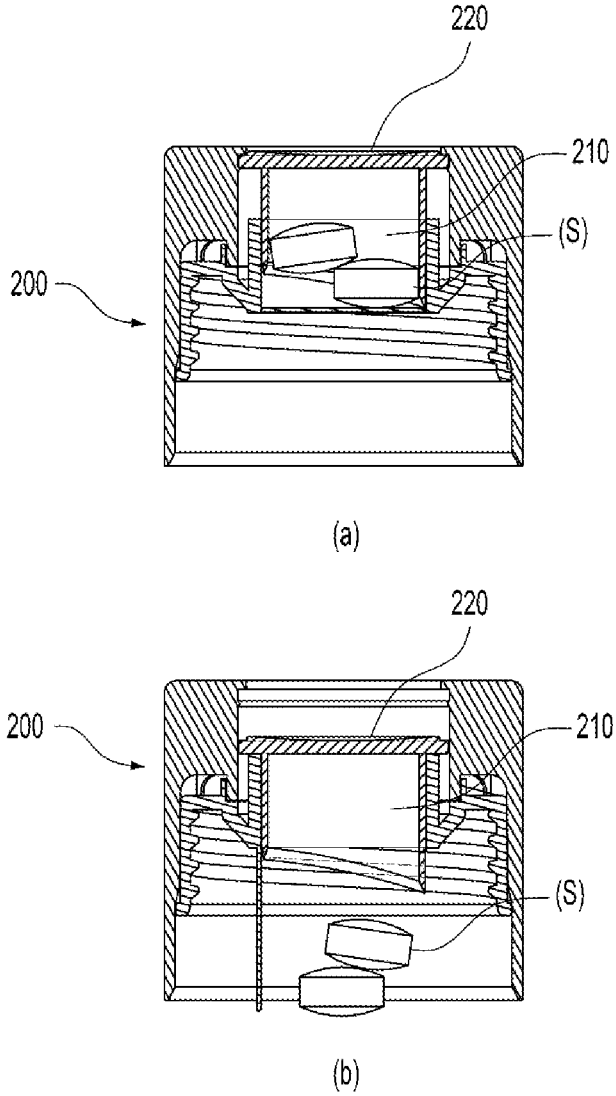
FIG. 8 is an operational state diagram of the content container according to the embodiment of the present disclosure.

FIG. 8 is an operational state diagram of the content container according to the embodiment of the present disclosure.

Referring to FIG. 8, the solid content S may be provided to the user separately from the liquid content. To this end, in a state in which the solid content S is located in the first accommodation part 210, the upper cap 200 may be separated from the container part 100 and the lower cap 300 (see FIG. 8A). In the separated upper cap 200, when the pressing part 220 is pressed, the pressing part 220 may open the first accommodation part 210 to discharge the solid content S to the outside (see FIG. 8B). Through this, the user may receive the solid content S regardless of the container part 100 or the liquid content accommodated in the container part 100.

Figure 9:
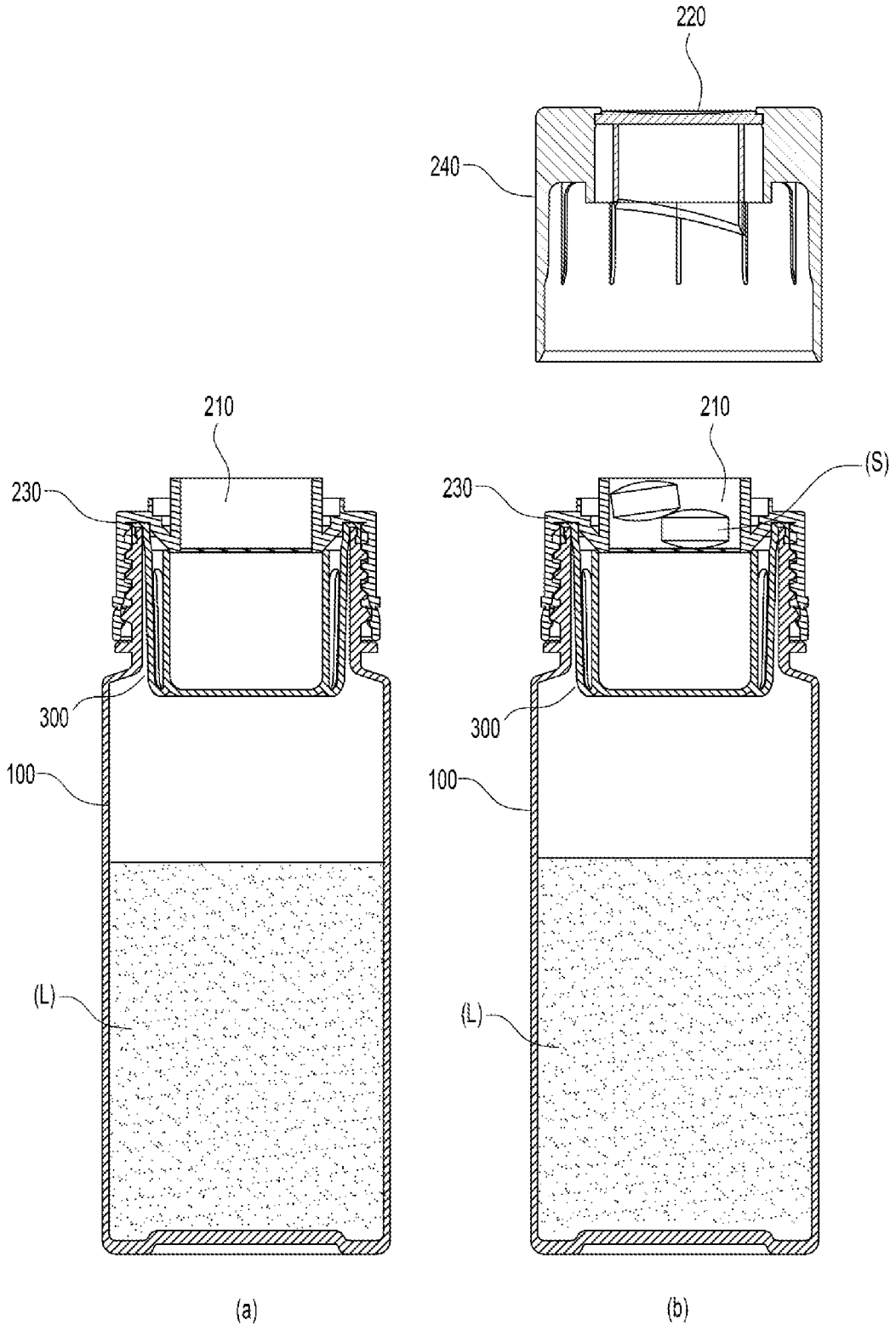
FIG. 9 is an assembling process diagram of the content container according to the embodiment of the present disclosure.

FIG. 9 is an assembling process diagram of the content container according to the embodiment of the present disclosure.

Referring to FIG. 9A, the container part 100 is filled with the liquid content L, and then the lower cap 300 and the inner cap 230 may be sequentially coupled. For example, the lower cap 300 may be coupled to the locking groove 120 of the upper end 110 of the container part 100 through the locking part of the outer frame 340. In the inner cap 230, a thread of the inner wall 232 and a thread of the upper end 110 of the container part 100 may be screw-coupled to each other.

Continuing on, referring to FIG. 9B, the solid content S may be located in the first accommodation part 210 of the inner cap 230. Thereafter, by coupling an assembly of the outer cap 240 and the pressing part 220 to the inner cap 230, the content container 1000 filled with the liquid content L and the solid content S may be completed.

Figure 10:
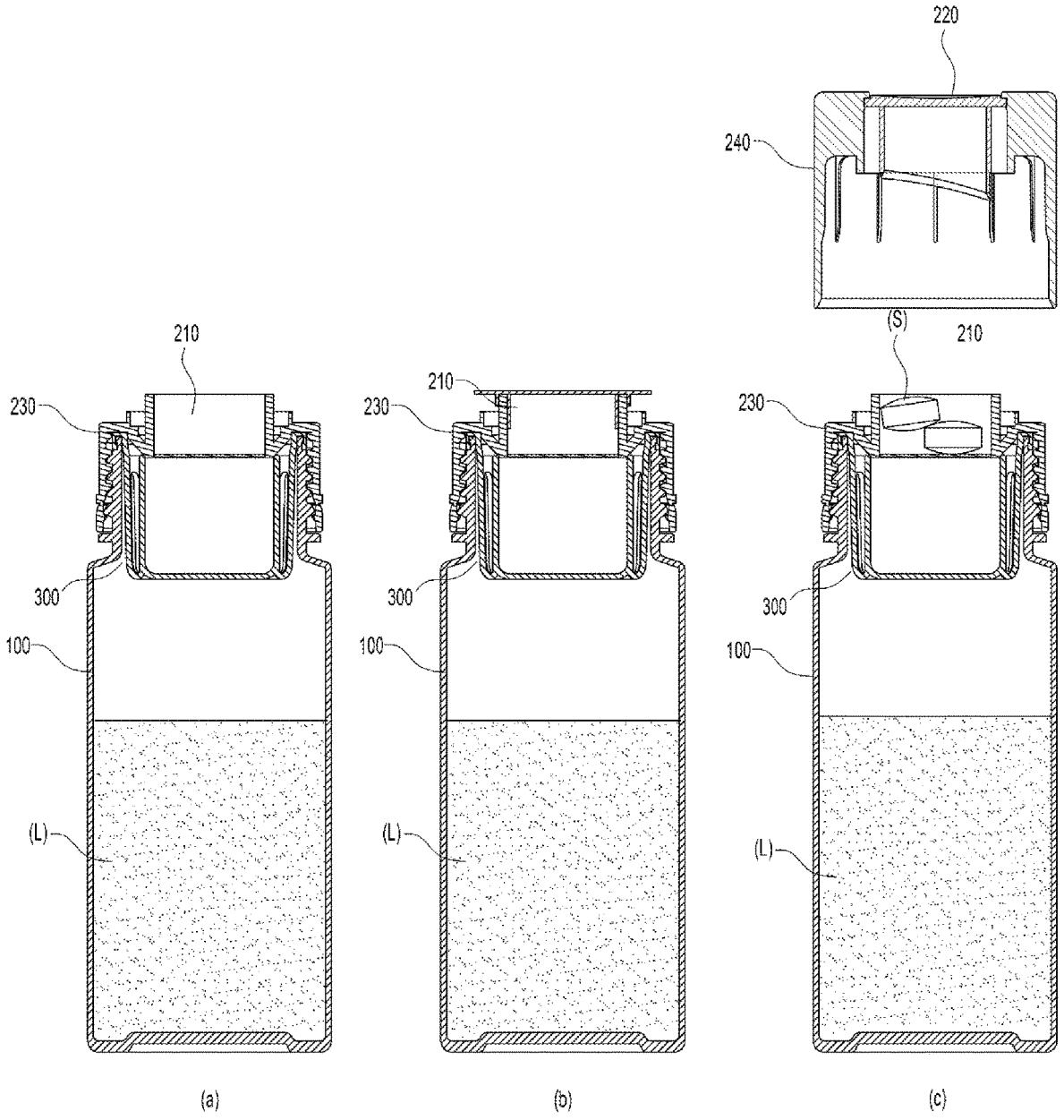
FIG. 10 is an assembling process diagram of the content container according to the embodiment of the present disclosure.

FIG. 10 is an assembling process diagram of the content container according to the embodiment of the present disclosure.

FIG. 10 will be described in the same manner as FIG. 9, and hereinafter, duplicated description will be omitted.

Referring to FIG. 10B, the container part 100 may be filled with the liquid content L, the lower cap 300 and the inner cap 230 are coupled to each other, and then an inner cap lid may be additionally coupled.

The inner cap lid is coupled to the upper end of the inner cap 230 to seal the first accommodation part 210. By coupling the inner cap lid to the first accommodation part 210, moisture generated due to heat generated when the liquid content L is filled and/or water vapor (moisture) generated in a sterilization process may be prevented from infiltrating into the first accommodation part 210. That is, the solid content S may be prevented from being melted or spoiled due to moisture inside the first accommodation part 210.

Thereafter, when the inner cap lid is removed, the solid content S is located in the first accommodation part 210 of the inner cap 230, the assembly of the outer cap 240 and the pressing part 220 is coupled to the inner cap 230, and thus the content container 1000 filled with the liquid content L and the solid content S may be completed.

Although FIG. 10 illustrates a process of coupling the inner cap lid is performed before the solid content S is filled, this is illustrative. According to the embodiments, after the solid content S is filled, the inner cap lid may be coupled, and the sterilization process and the like may be performed.

In the above, the coupling between the components has been described as screw coupling, fitting coupling, engaging coupling, and the like, but this is illustrative, and according to the embodiments, various coupling manners may be applied. For example, in the fitting coupling, a protrusion and a groove may be interchanged or other coupling manners such as the screw coupling may be applied instead of the fitting coupling.

As described above, although the embodiments have been described with reference to limited embodiments and limited drawings, various modifications and changes may be made based on the above description by those skilled in the art. For example, even though the described technologies are performed in an order different from the described method, and/or components are coupled or combined in a form different from the described method or are replaced or substituted by other components or equivalents, appropriate results may be achieved. Further, respective embodiments may be applied in combination with each other as needed. Therefore, other implementations, other embodiments, and those equivalents to the appended claims also belong to the scope of the appended claims.

What is claimed is:

1. A content container comprising:

a container part configured to accommodate a liquid content;

a first cap detachably coupled to an upper end of the container part, the first cap having:

a first accommodation part configured to accommodate a solid content and a pressing part configured to be moved in reply to a predetermined external force; and a second cap inserted into the container part, the second cap having:

an accommodation tube, a second accommodation part defined in the accommodation tube, and a plurality of communication holes disposed external to the accommodation tube, the plurality of communication holes configured to allow a flow of the liquid content from the container part to an outside of the content container, wherein the solid content is configured to move from the first accommodation part to the second accommodation part as the pressing part moves, and wherein a bottom surface of the first cap is in sealed contact with an upper end of the accommodation tube, and the second accommodation part is thereby sealed.

2. The content container of claim 1, wherein at least a portion of the pressing part is configured to be exposed to the outside of the content container and the pressing part is configured to be moved by the predetermined external force, and wherein the first accommodation part is configured to be opened by a movement of the pressing part and the solid content is configured to move from the first accommodation part to the second accommodation part when the first accommodation part is opened.

3. The content container of claim 2, wherein the pressing part comprises:

a pressing wall disposed in a horizontal direction and configured to receive the predetermined external force; and a support tube extending in a direction toward a sealing part from the pressing wall and having an inclined end, wherein when the pressing part moves, the inclined end is configured to cut a bottom surface of the first accommodation part to open the first accommodation part.

4. The content container of claim 3, wherein the inclined end is configured to cut only a portion of the bottom surface of the first accommodation part, and the bottom surface of the first accommodation part is configured to be prevented from being separated from the first cap and from being moved to the second accommodation part when the portion of the bottom surface of the first accommodation part is cut by the inclined end.

5. The content container of claim 1, wherein at least a portion of the pressing part is made of a transparent or semitransparent material, and an inside of the first accommodation part is visible through the pressing part.

6. The content container of claim 1, wherein a sealed structure of the accommodation tube blocks the solid content in a state in which the solid content is moved to the second accommodation part and the liquid content in the container part from each other.

7. The content container of claim 1, wherein, when the first cap is detached from the container part in a state in which the solid content is located disposed in the first accommodation part, the first cap is configured to discharge the solid content from the first accommodation part to the outside of the content container in reply to the external force applied to the pressing part.

8. The content container of claim 1, wherein, when the first cap is detached from the container part after the solid content moves to the second accommodation part, the second accommodation part and the plurality of communication holes are configured to be opened, and the solid content and the liquid content are configured to be exposed to the outside of the content container through the second accommodation part and the plurality of communication holes, respectively.

9. The content container of claim 1, wherein the second accommodation part is disposed below the first accommodation part and is configured to function as an air pocket for the first accommodation part.

10. The content container of claim 1, wherein the second cap further comprises:

an outer frame having a locking part configured to couple to the upper end of the container part; and a bridge connecting the outer frame and the accommodation tube to define the plurality of communication holes.

11. The content container of claim 1, wherein the first cap further comprises:

an inner cap detachably coupled to an outside of the upper end of the container part; and an outer cap coupled to an outside of the inner cap and configured to accommodate the pressing part.

12. The content container of claim 11, wherein the outer cap comprises:

an upper wall having a through region defined therein;

an outer wall extending in a direction toward a bottom surface of the container part along a circumference of the upper wall and in contact with the inner cap; and a protection tube extending in the direction toward the bottom surface of the container part along a circumference of the through region and the protection tube having the pressing part disposed therein, wherein the protection tube is configured to guide a movement of the pressing part.

13. The content container of claim 11, wherein the outer cap comprises a first protrusion and a second protrusion respectively in contact with a first surface and a second surface of the pressing part to maintain a position of the pressing part.

14. The content container of claim 11, wherein the inner cap comprises:

an inner wall detachably coupled to the upper end of the container part;

a sealing part extending inward from the inner wall and in contact with the accommodation tube to seal the second accommodation part; and a guide tube extending from the sealing part in a direction opposite to the sealing part and defining a portion of the first accommodation part, wherein the guide tube is configured to guide a movement of the pressing part and limit a movement range of the pressing part.

15. A content container comprising:

a container part configured to accommodate a liquid content;

a first cap detachably coupled to an upper end of the container part, the first cap having:

a first accommodation part configured to accommodate a solid content and a pressing part configured to be moved in reply to a predetermined external force; and a second cap inserted into the container part, the second cap having:

an accommodation tube, a second accommodation part defined in the accommodation tube, and a plurality of communication holes disposed external to the accommodation tube and the plurality of communication holes configured to allow a flow of the liquid content from the container part to an outside of the content container, wherein the solid content is configured to move from the first accommodation part to the second accommodation part as the pressing part moves, and wherein the accommodation tube has a sealed structure configured to block the solid content in a state in which the solid content is moved to the second accommodation part and the liquid content in the container part from each other.

* * * * *